US009939126B2

(12) United States Patent
Dingemans et al.

(10) Patent No.: US 9,939,126 B2
(45) Date of Patent: Apr. 10, 2018

(54) LIGHTING UNIT

(71) Applicant: PHILIPS LIGHTING HOLDING B.V., Eindhoven (NL)

(72) Inventors: Antonius Petrus Marinus Dingemans, Eindhoven (NL); Michel Cornelis Josephus Marie Vissenberg, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 44 days.

(21) Appl. No.: 15/024,569

(22) PCT Filed: Sep. 24, 2014

(86) PCT No.: PCT/EP2014/070296
§ 371 (c)(1),
(2) Date: Mar. 24, 2016

(87) PCT Pub. No.: WO2015/044161
PCT Pub. Date: Apr. 2, 2015

(65) Prior Publication Data

US 2016/0230952 A1 Aug. 11, 2016

(30) Foreign Application Priority Data

Sep. 24, 2013 (EP) ..... 13185683
Apr. 15, 2014 (EP) ..... 14164755

(51) Int. Cl.

| | |
|---|---|
| ***F21V 1/00*** | (2006.01) |
| ***F21V 11/00*** | (2015.01) |
| ***F21V 5/00*** | (2018.01) |
| ***F21S 8/02*** | (2006.01) |
| *F21Y 105/10* | (2016.01) |
| *F21Y 115/10* | (2016.01) |
| *F21Y 101/00* | (2016.01) |

(52) U.S. Cl.
CPC ..... *F21V 5/007* (2013.01); *F21S 8/026* (2013.01); *F21Y 2101/00* (2013.01); *F21Y 2105/10* (2016.08); *F21Y 2115/10* (2016.08)

(58) Field of Classification Search
CPC . F21V 1/00; F21V 11/00; F21V 13/00; F21V 13/02; F21V 7/04
USPC ..... 362/235, 84, 241, 343, 606–608
See application file for complete search history.

(56) References Cited

U.S. PATENT DOCUMENTS

| | | | |
|---|---|---|---|
| 5,462,700 | A | 10/1995 | Beeson |
| 5,481,385 | A | 1/1996 | Zimmerman et al. |
| 5,521,726 | A | 5/1996 | Zimmerman et al. |
| 5,657,408 | A | 8/1997 | Ferm et al. |
| 7,050,227 | B2 | 5/2006 | Olofson et al. |
| 2001/0019748 | A1 | 9/2001 | Beeson et al. |

(Continued)

FOREIGN PATENT DOCUMENTS

| | | |
|---|---|---|
| DE | 102006009325 | 9/2007 |
| EP | 2306073 | 4/2011 |

(Continued)

*Primary Examiner* — Edwyn Labaze

(57) ABSTRACT

A lighting panel comprises a light source and a light modifying panel positioned over the light source, in the form of a set of protrusions over the base, the protrusions facing the light source. The protrusions comprise circular/elliptical/polygonal cylinders or cone sections with a small cone taper angle.

14 Claims, 12 Drawing Sheets

(56) References Cited

U.S. PATENT DOCUMENTS

| | | | | |
|---|---|---|---|---|
| 2002/0048168 | A1 | 5/2002 | Sejkora et al. | |
| 2010/0097809 | A1 | 4/2010 | Munro et al. | |
| 2010/0177495 | A1 | 7/2010 | Van Oers et al. | |
| 2011/0286200 | A1 | 11/2011 | Iimura et al. | |
| 2011/0292655 | A1* | 12/2011 | Ing | G09F 13/14 362/241 |
| 2012/0068615 | A1 | 3/2012 | Duong et al. | |
| 2013/0039090 | A1* | 2/2013 | Dau | F21S 8/04 362/551 |
| 2014/0104871 | A1* | 4/2014 | Boyd | G02B 6/0053 362/606 |
| 2015/0228813 | A1* | 8/2015 | Wertsberger | H01L 27/142 257/84 |

FOREIGN PATENT DOCUMENTS

| | | |
|---|---|---|
| WO | WO2005083317 | 9/2005 |
| WO | WO2011039690 | 4/2011 |
| WO | WO2013057644 | 4/2013 |

* cited by examiner

LIGHTING UNIT

CROSS-REFERENCE TO PRIOR APPLICATIONS

This application is the U.S. National Phase application under 35 U.S.C. § 371 of International Application No. PCT/EP2014/070296, filed on Sep. 24, 2014, which claims the benefit of European Patent Applications Nos. 14164755.2, filed on Apr. 15, 2014 and 13185683.3, filed on Sep. 24, 2013. These applications are hereby incorporated by reference herein.

FIELD OF THE INVENTION

This invention relates to a lighting unit, such as a luminaire, which includes a panel for positioning between a light source and a space to be illuminated, in order to control the distribution of the light entering the space to be illuminated.

BACKGROUND OF THE INVENTION

Lighting panels in the form of a plate with multiple microlenses are known for use in luminaires, to hide the light source (such as a fluorescent tube or LED) and to deliver a preferred light distribution. The preferred light distribution can depend on national guidelines. For example, a microlens optics plate is widely used in Europe and acrylic plates are widely used in North America. Typically, these are made by hot embossing which is a relatively costly batch process (highly dependent on the base material) and limited to plate materials. Three dimensional lenses or exit windows beyond a single curve are therefore hard to obtain.

WO 2005/083317 describes a microlens optics plate for use in luminaires. The plate is a transparent substrate with tapered protrusions that end in a sharp point or in a sharp edge. Most of the light enters the plate via the flat side and exits via refraction at a tapered conical surface. The plate transmits part of the light from a diffuse source within a limited intensity cone (the intensity distribution required to comply with EU regulations) and recycles the remaining part back to the source, where it is reflected and has a second chance to pass the plate.

In designing office luminaires there are a number of optical problems that have to be taken into account.

The actual preferred light intensity distribution depends on the region. In Europe, office luminaires have to comply with EN-12464-1 which prescribes certain horizontal task illumination Lux levels and has strict glare rules that limit the luminaire luminance at large angles with respect to the normal.

In North America the glare limits are less strict, which allows for more light at large angles. The advantage of this is a larger luminance spacing (giving lower cost) and more vertical luminance (better lighting of the walls). The drawback is a lower utilisation efficiency (less light to the task area) and more glare.

Especially for LED lighting, it is necessary to reduce the brightness of the LED source. The high brightness of LEDs can give discomfort glare. High peak brightness typically means a dotty but efficient product. High brightness is especially problematic under angles that are directly in the field of view of an office worker. The luminaire directly above a person is not directly visible and can therefore have a higher brightness than further away when it is within a person's visual field. Typically, the visual field of a person looking straight ahead starts at about 35 degrees with respect to the vertical orientation. Therefore, there is no direct glare from luminaires at viewing angles between 0 and 35 degrees with respect to the vertical. In general, the discomfort glare by a high luminance source in the ceiling increases with increasing angle to the vertical plane (assuming that the people in the room look straight ahead or downward to a screen or desk).

Thus, high peak brightness should be avoided at large angles to the vertical (i.e. for rays with a large vector component in the plane of the luminaire exit window and ceiling), but higher values may be permitted at low angles (i.e. for rays directed downwardly from the ceiling). Since high homogeneity comes at the cost of decreasing optical efficiency, generally requiring more light recycling, it is preferable to homogenize the luminance only at higher viewing angles where it is really required.

SUMMARY OF THE INVENTION

The invention is defined by the claims.

According to the invention, there is provided a lighting panel, comprising:

a light source; and a light modifying panel positioned over the light source for modifying the light output from the light source before it enters a space to be illuminated, wherein the panel comprises a base and a set of protrusions over the base, the protrusions facing the light source, wherein the protrusions comprise circular, elliptical or at least 5-sided polygonal cylinders, or circular, elliptical or at least 5-sided polygonal cone sections, having a flat circular elliptical or polygonal top, wherein for cone sections the cone taper angle is less than 5 degrees.

The shape of the protrusions is preferably circular, although an equivalent effect can be obtained with a polygon with multiple sides or a slightly elliptical shape. Thus, if the protrusions are polygonal, they have at least five sides to provide a substantially uniform angular distribution. The polygon is preferably a regular polygon, i.e. with rotational symmetry of order N where N is the number of sides.

This cylindrical shape (equivalent to a cone with zero taper angle), or shallow cone taper means the protrusions conserve beam shape along the radial direction (i.e. the average intensity profile as a function of angle to the optical axis is conserved, or slightly narrowed for the conical version), The protrusions homogenise the beam shape along the tangential direction, so that a non-rotationally symmetric input beam will be more symmetric after passing through the panel. The shallow or no tapering means the input area (at the tops) can occupy a large area. This means that light blocking features between the protrusions can be avoided.

This arrangement gives a higher peak brightness close to the optical axis (for example in the range 0-35 degrees), where the underlying light source is more visible and lower peak brightness (more uniform luminance) at angles directly in the field of view (for example in the range 35-90 degrees). The actual angles depend on the height to radius ratio of the protrusions.

The structure of the invention functions differently to a conventional optical scattering plate. A conventional scattering plate usually scatters the direction of the light both in the radial direction (changing the radial angle with respect to the optical axis of the beam) and in the tangential direction (changing the polar angle in the plane perpendicular to the optical axis).

In a luminaire, the radial intensity distribution defines the beam shape as projected into the space. This distribution is designed such to balance the light spreading in the room (wide distribution to keep the numbers of luminaires low and to provide good lighting on the walls) with the conflicting constraints on glare (which require reduced light at high radial angles). High light utilization is desired, so that light is aimed at desks for example. The tangential intensity distribution is usually uniform (i.e. for a given radial angle, the same intensity is provided to all directions in the room). Consequently, scattering light in the radial direction has a large impact on other beam properties like glare, while scattering in the tangential direction has less impact on the beam profile.

The optical structure of the invention provides scattering mainly in the tangential direction. As a result, the beam shape of a rotationally symmetric beam is not significantly changed. This means the system can homogenise the luminance without significantly altering a rotationally symmetric beam shape.

The advantage of this property is that the scattering plate can be kept the same for different beam shapes that may be required for different applications or regions. Thus, the optical design can have the same look and feel for luminaires with different beam shape light distributions.

By preserving beam shapes in this way, a light source which provides multiple beams can also be used. For example, a split beam luminaire is known which provides separate task and ambient beams. The optical system enables multiple different beams to pass to through the same system while preserving the beam shapes.

Thus, the invention is based on providing cones with a very small slant angle or even cylinders, so that the plate acts as a scattering plate that scatters mainly in tangential directions. This provides particular advantages for office lighting:

the plate reduces brightness by scattering in the tangential direction only, thus retaining incoming rotationally symmetric light distributions. In this way, beams which are radially pre-shaped before passing through the panel to be rotationally symmetric can conserve this symmetry;

the arrangement has high scattering with good brightness reduction, at angles in the field of view of an office worker or any other end-user;

has a high transmission, therefore with little backscatter and little need for recycling, and this gives high overall efficiency;

the arrangement is easy to produce, for example using injection moulding processes;

it enables different light sources to be used, with different light distributions;

it has a similar look and feel irrespective of the particular light distribution being sought;

it has a smooth (and optionally also flat) outer surface which is easy for maintenance/cleaning.

The cone taper angle can be less than 2 degrees, or less than 1 degree.

In one example, the protrusions each have a height H which satisfies $H>N(D-H*\tan\alpha)$, where $\alpha$ is the cone taper angle and D is the diameter of the tip, and N is given by $1/N=\tan(\sin^{-1}(\sin 35/n))$ where n is the refractive index of the panel material.

This formula determines the transition from high scattering (at high angles to the vertical) to low scattering (at low angles to the vertical). The low scattering regime is outside the visual field of view (which, in above formula taken to be 35 degrees and higher).

The light source preferably comprises an array of LEDs.

In one example, an array of beam shaping elements can be provided over the LED array, for example with one beam shaping element in the form of a lens over each LED. The beam shaping function is between the light source and the panel, and can be tuned to meet local needs.

The beam shaping elements can perform a beam shaping function, and can produce a beam with a good cut-off complying with EU office regulations. The same panel can be used with batwing-type beam shaping lenses to produce very broad beams particularly useful for the North American market.

The beam shaping element may be:

a lens per LED or per cluster of LEDs;

a collimator per (cluster of) LED(s), such as a TIR collimator or metallic reflector or white reflector;

a microlens plate covering a cluster of LEDs; or optical foils with beam shaping surface structures (microlenses, microprisms) covering an array of LEDs.

The beam shaping array can comprise at least first and second different types of structure. For example, different microlenses can be used with different properties for different types of illumination.

The base can comprise a light scattering surface on a side opposite the protrusions. The scattering can be limited, and can then enable direct view of the light source to be prevented, even from directly along the optical axis. A controlled diffuser (with limited scattering) between the light source and the panel can be used for the same purpose.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting panel comprising a light source and a light modifying panel positioned over the light source, in the form of a set of protrusions over a base, the protrusions facing the light source. The protrusions comprise circular/elliptical/polygonal cylinders or cone sections with a small cone taper angle.

Figure 1:
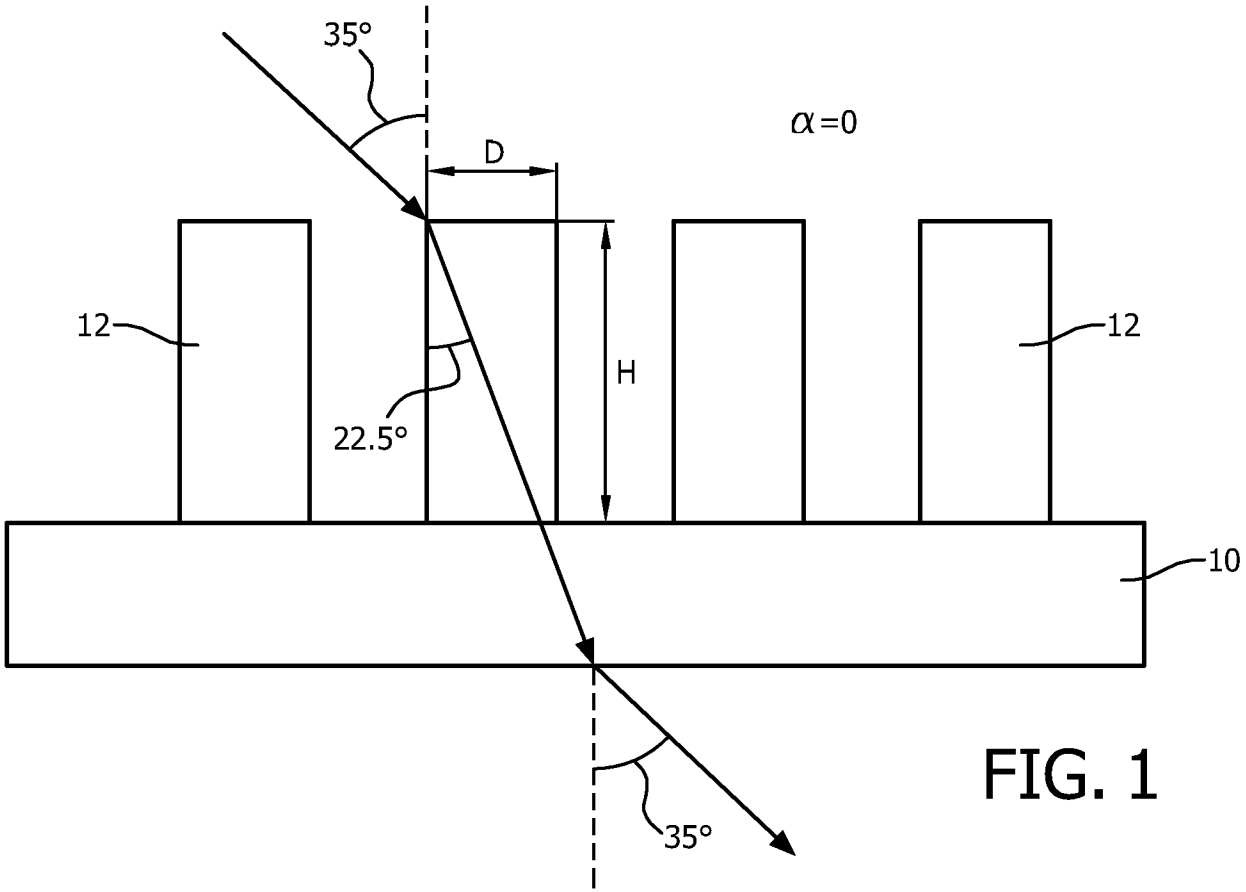
FIG. 1 shows a side view of the shape of one example of light modifying panel for use in a lighting unit of the invention.

FIG. 1 shows the shape of one example of light modifying panel of the invention. The panel comprises a base 10 and a set of protrusions 12 over the base, the protrusions facing the light source (not shown in FIG. 1). In this example, the protrusions comprise circular cylinders having a flat circular top. They may instead comprise tapered cones, but with a small cone taper angle $\alpha$ (shown in FIG. 5), in particular less than 5 degrees (whereas in FIG. 1 $\alpha=0$). The height of the protrusions is shown as H and the diameter of the circular bottom and top is shown as D. For tapered cone sections the parameter D is taken to be the smaller diameter at the cone tip.

This design provides an optimal scattering function with conservation of beam shape. The small tapering angle of less than 5 degrees, or preferably less than 2 or even 1 degree may be needed for injection moulding purposes, but no tapering is required for the scattering function.

The panel can be formed from a plastics material, such as polymethyl methacrylate ("PMMA") or polycarbonate.

For an optimum brightness reduction of luminance at viewing angles within the usual field of view (more than 35 degrees to the normal of the plate), the protrusions should have a height H larger than a multiple N times the base diameter D of the protrusion. This multiple N depends on the refractive index of the panel and the medium in which the panel is situated. For a refractive index 1.49 (for PMMA) in air, the value N can be 2.4.

Thus H>ND. With H>2.4 D for the example given of zero taper angle, no light rays at angles greater than 35 degrees can enter the protrusion at the top facet and exit at the flat substrate without at least one interaction with the curved protrusion sidewall.

For slanted sidewalls with slant angle $\alpha$, the aspect ratio of the protrusion is given by $H>N(D-H*\tan\alpha)$.

The value N is set to achieve the 35 degree threshold. It is given by:

$$1/N=\tan(\sin^{-1}(\sin 35/n))$$ where $n$ is the refractive index of the panel material.

For n=1.49, this gives N=2.40, and for polycarbonate with n=1.58, it gives N=2.57. For typical materials, N is in the range 2.3 to 2.7.

Figure 2:
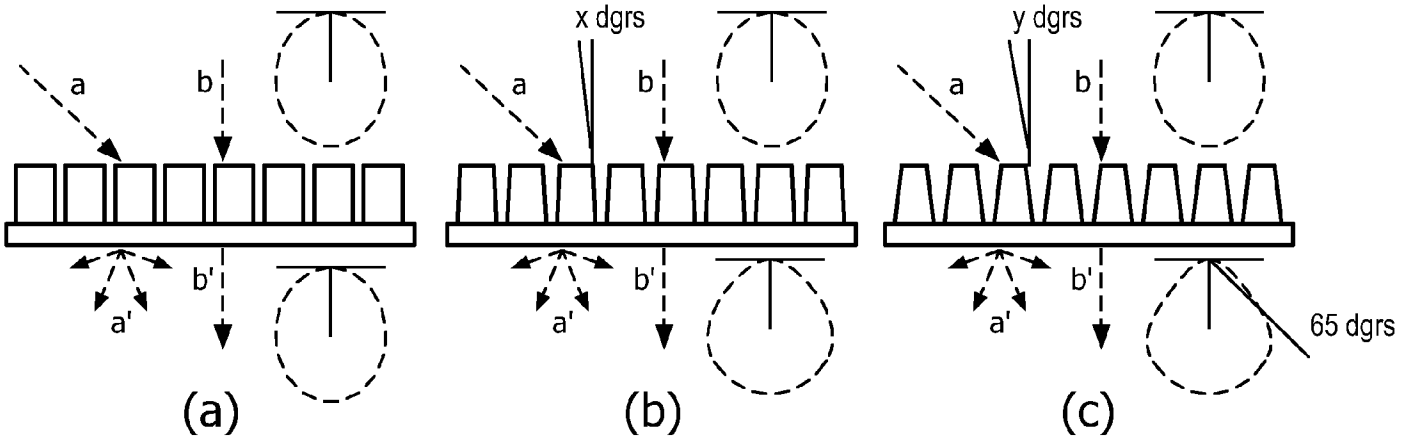
FIG. 2*a-c* shows a side view of the effect of varying the cone angle for conical projections.

FIG. 2 is used to show the difference in optical function between a purely angular scattering plate and a collimating plate. The light intensity distribution before and after the panel is shown, above and below the panel. In each case, the intensity distribution entering the panel is shown as a Lambertian distribution. Light 'a' under shallow is scattered in all directions (shown as a') and slightly refracted towards the vertical axis, depending on the tapering angle. Light 'b' under steep angles is little scattered.

The examples of FIG. 2 are all within the scope of the invention. The cone taper angle is however exaggerated in the figure.

FIG. 2(*a*) shows the effect of cylindrical protrusions. The protrusions scatter light rays 'a' at a large angle, but not the rays 'b' perpendicular to the panel. The beam shape is conserved, so that the Lambertian beam stays Lambertian.

When the protrusions are slightly conical as shown in FIG. 2(*b*), the exit beam is slightly collimated, which may for example be enough to comply with North American regulations for office lighting.

When the protrusions have an increased cone angle as shown in FIG. 2(*c*), the exit beam is much more collimated, such that it can comply with EU regulations for office lighting.

The cylindrical structure of FIG. 2(*a*) is the most light efficient but the less efficient structures are needed to meet office requirements.

The protrusions can be distributed in many ways. The total area covered with the protrusions should be relatively high.

Figure 3:
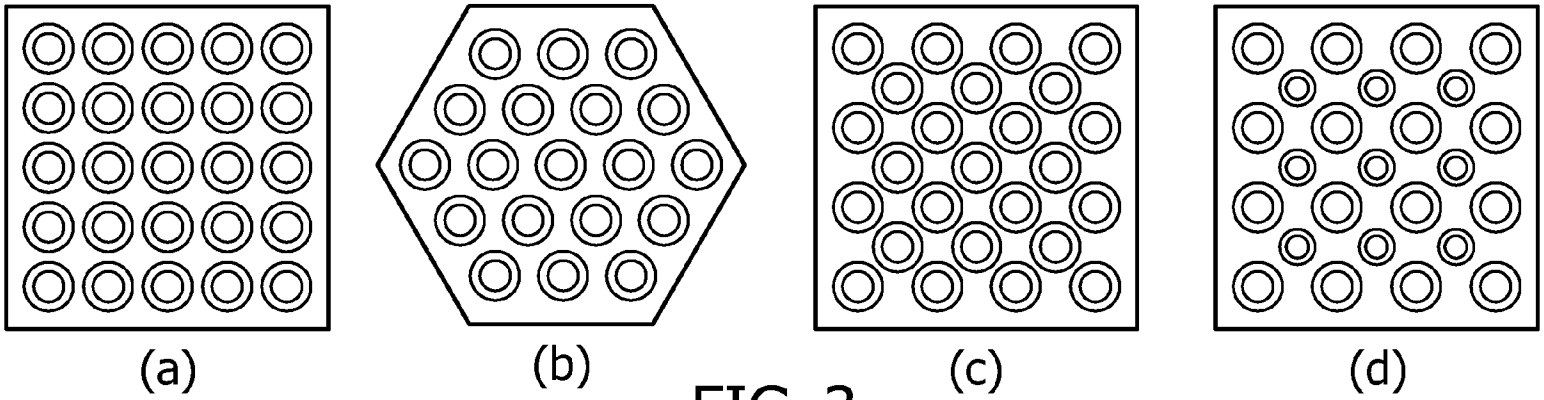
FIG. 3*a-d* shows a top view of possible arrangements of multiple protrusions.

FIG. 3(*a*) shows a regular square orthogonal grid array of protrusions. FIG. 3(*b*) shows a regular hexagonal grid array of protrusions. FIG. 3(*c*) shows a square orthogonal grid array but rotated by 45 degrees. FIG. 3(*d*) shows two grids with protrusions of different sizes, interleaved.

By having a small slant angle, the light input area (the flat tip of the protrusions) is kept large. This limits the area of the slanted facets that capture light, and means than blocking masks can be avoided, which otherwise may be needed to prevent that too much light enters the plate via the curved sides.

The arrangement of the invention can be used with additional measures to provide desired beam shaping.

In one example, beam shaping is provided using an injection-moulded lens array placed directly on the LEDs. Since rotationally symmetric beams are conserved by the panel, any rotationally symmetric beam may be generated in combination with the same panel design.

A disadvantage of the panel design can be overhead glare.

Light under limited angles from the vertical axis is little scattered which results in high peak luminance looking from right underneath.

Figure 4:
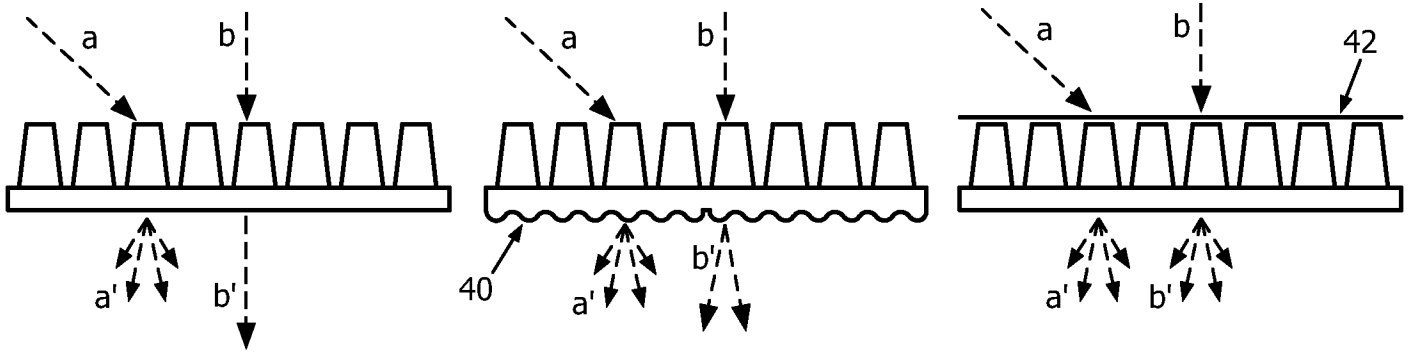
FIG. 4 shows further examples of light modifying panel of the invention.

To reduce the overhead glare, when looking back to the LED light source from directly underneath the luminaire, two possible solutions are shown in FIG. 4.

FIG. 4(*a*) shows the basic structure.

FIG. 4(*b*) shows a texture 40 applied to the mould. Known standard textures can be used to provide for a limited (for example less than 15 degree FWHM) beam dispersion as represented by light paths b'.

FIG. 4(*c*) shows the alternative of adding a diffuser 42 at the top facing the light source.

These improvements to address overhead glare have a negative trade-off for efficiency and mean that pre-shaped rotationally symmetric lighting distributions are no longer fully preserved. The use of diffusers on the top enables a modular approach so that they can be used only when desired.

Figure 5:
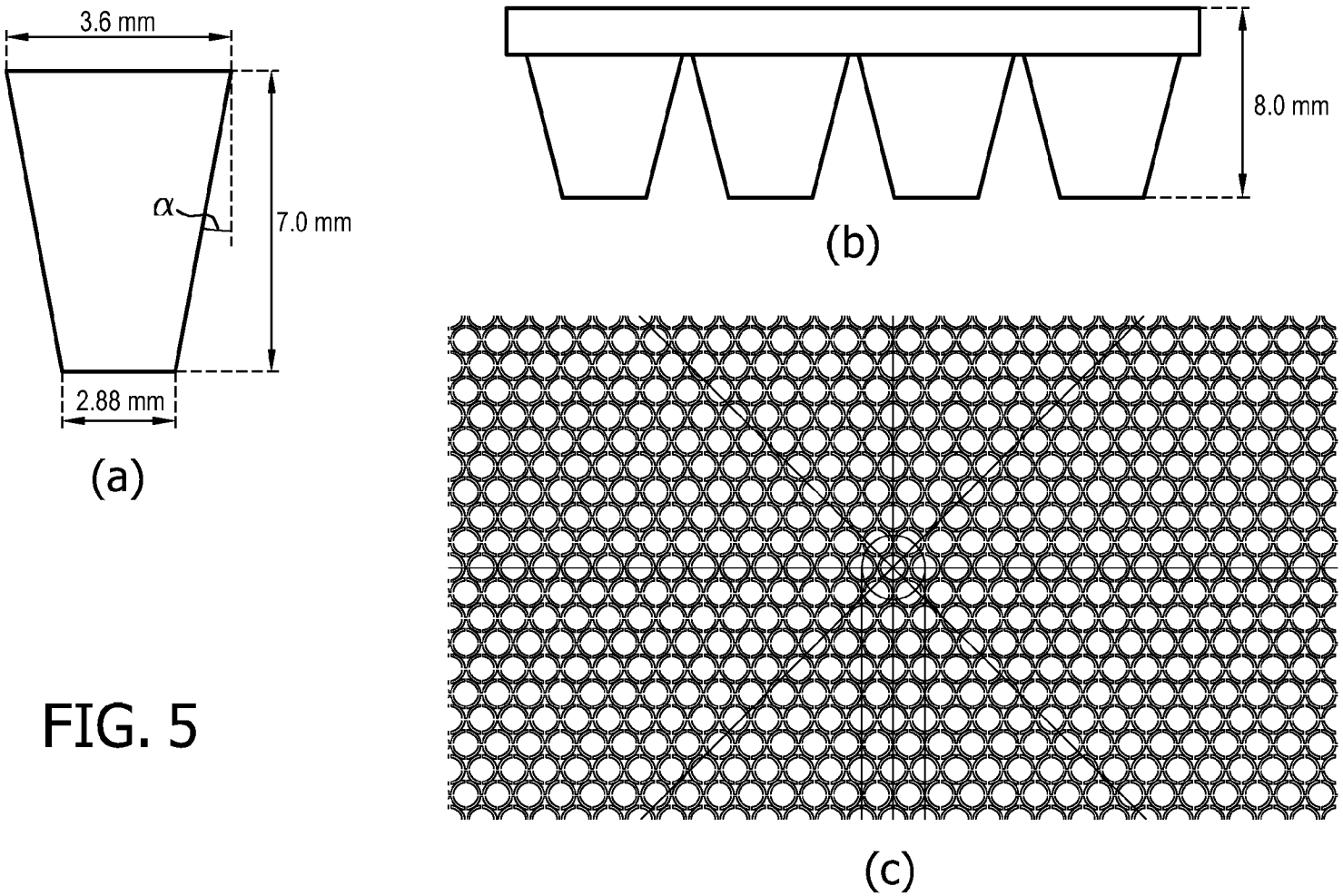
FIG. 5*a-c* shows one example of light modifying panel of the invention with dimensions.

FIG. 5 shows a first example of light modifying panel of the invention with dimensions.

This example is for use with a light source in the form of bare LEDs. The panel comprises a plate with truncated cones that collimate the beam to such an extent that it would be EU office compliant.

The dimensions of one protrusion are shown in FIG. 5(*a*), which give a cone angle of 2.94 degrees ($\tan^{-1}(0.36/7.0)$). This angle is shown exaggerated in FIG. 5.

For a refractive index 1.49, $N(D-H\tan\alpha)$ for this shape is equal to:

$$2.4(2.88-7.0\tan 2.94)=6.048.$$

Thus, this example satisfies $H>N(D-H\tan\alpha)$.

FIG. 5(*b*) shows that the protrusions are arranged in an array, and FIG. 5(*c*) shows a hexagonal distribution of the protrusions.

The total optical system efficiency can be greater than 90%, and as high as 95%.

This modest tapering angle of 3.44 degrees gives an intensity distribution with a reasonable beam cut-off for angles greater than 65 degrees, complying with EU regulations for glare.

Figure 6:
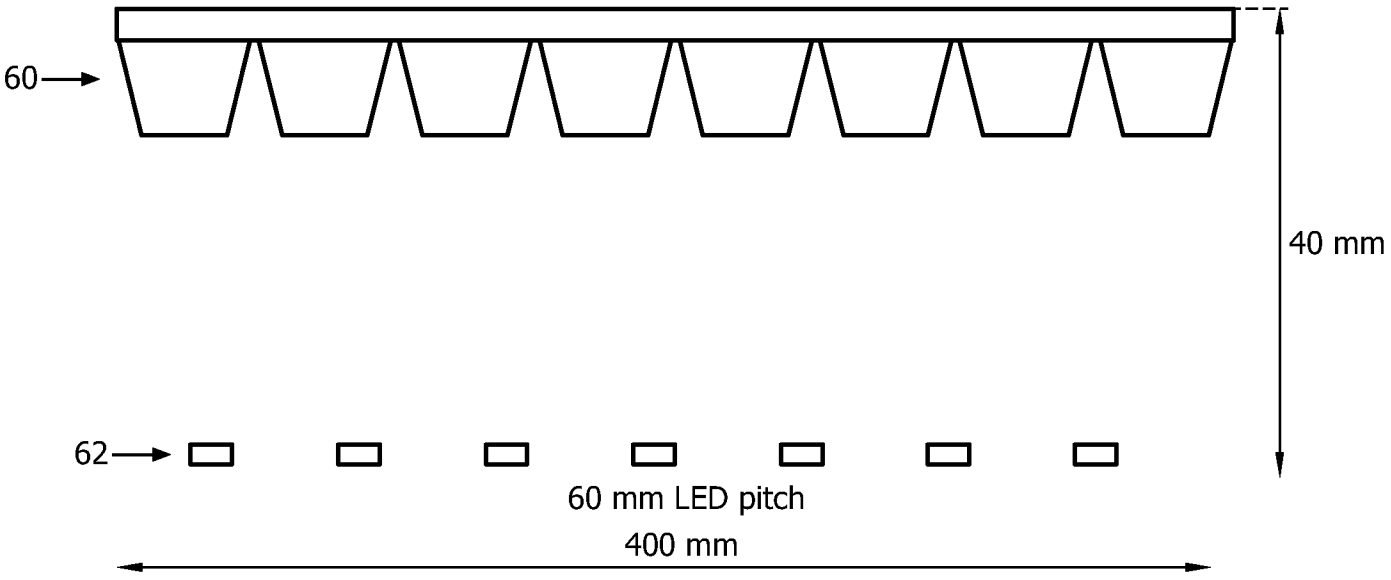
FIG. 6 shows the way the panel of FIG. 5 can be arranged with respect to an array of light sources.

FIG. 6 shows the possible arrangement of the panel 60 over the LED array 62, and shows an example spacing of 40 mm, and an overall luminaire dimension of 400 mm (for example square). The LED pitch is 60 mm, and the pitch of the protrusions is 3.6 mm (so it is clear that FIG. 6 is not to scale in this respect).

Figure 7:
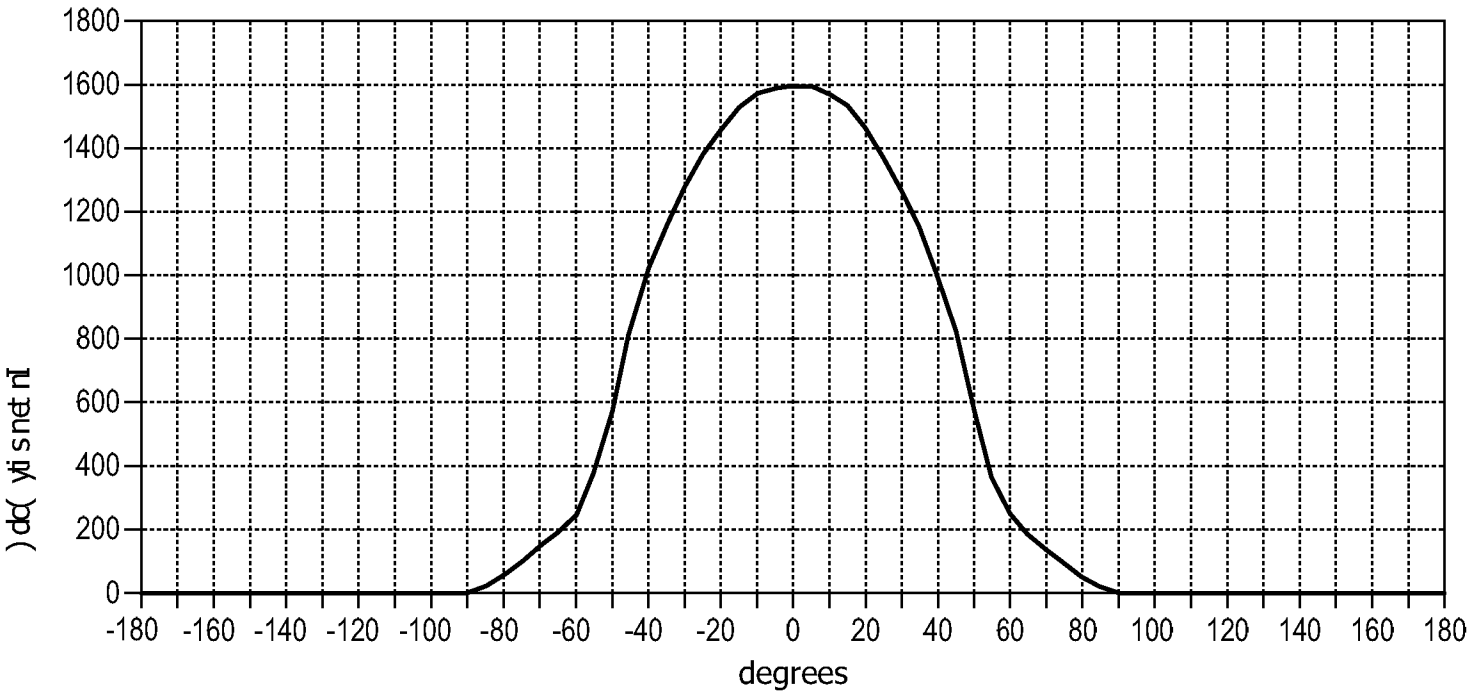
FIG. 7 shows the light intensity distribution resulting from the arrangement of FIGS. 5 and 6.
Figure 8:
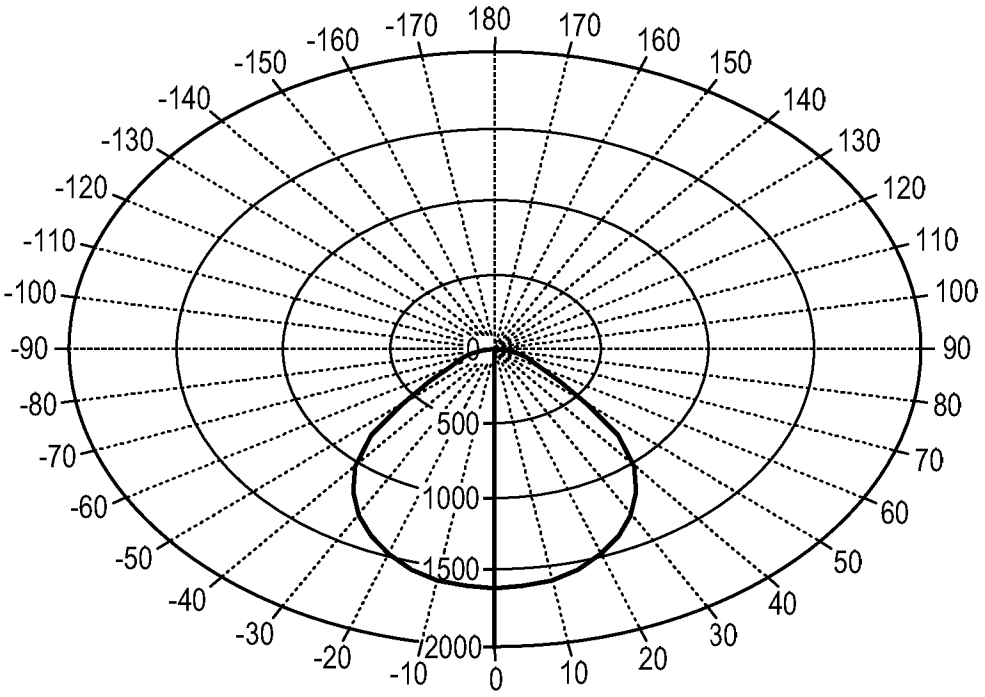
FIG. 8 shows a polar plot for the light distribution resulting from the arrangement of FIGS. 5 and 6.

FIG. 7 shows the intensity distribution with respect to the angle to the normal and FIG. 8 shows the polar plot.

The simulation to provide the results of FIGS. 7 and 8 finds a very high optical efficiency of over 94%.

Figure 9:
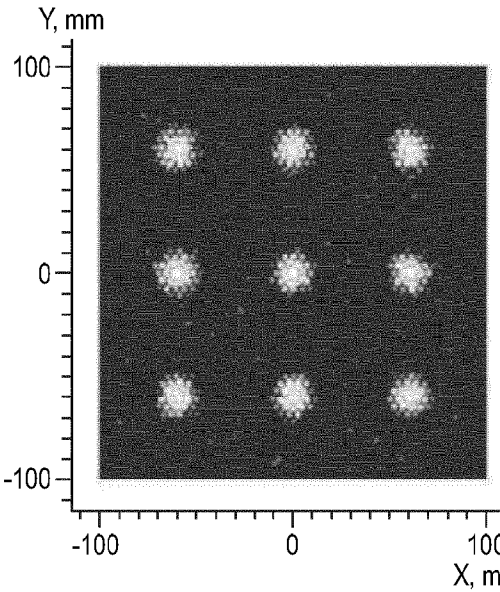
FIGS. 9 to 11 show the perceived luminance at different angles with respect to the lighting unit.
Figure 10:
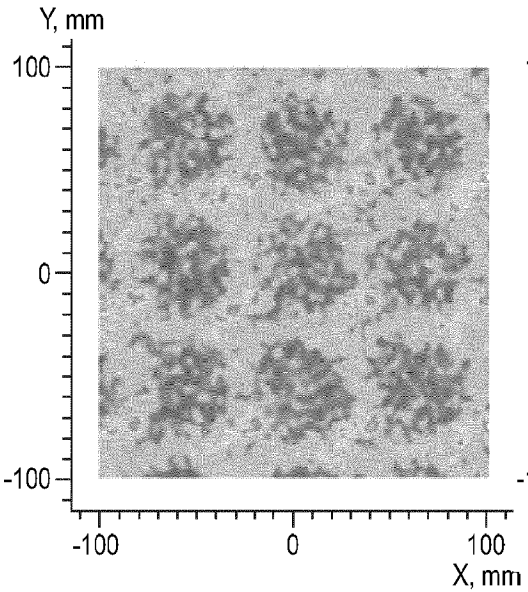
Figure 11:
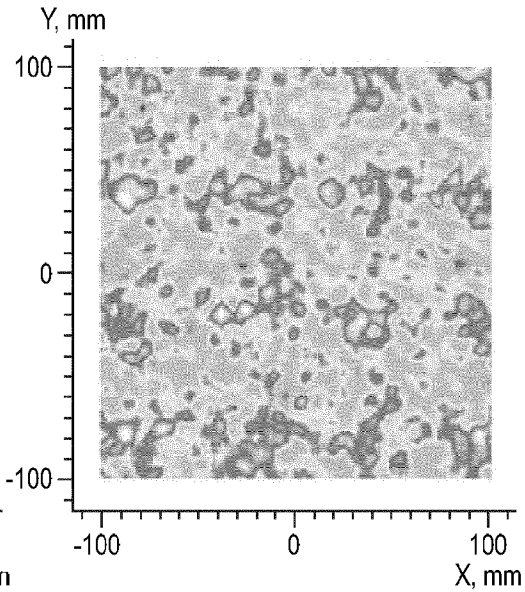

The luminance distribution of the exit window of the panel is shown in FIGS. 9 to 11. FIG. 9 shows the luminance distribution viewed at zero degrees to the optical axis, namely directly beneath the luminaire.

FIG. 10 shows the luminance distribution viewed at 35 degrees to the optical axis, and FIG. 11 shows the luminance distribution viewed at 65 degrees to the optical axis.

There is almost no brightness reduction at the perpendicular viewing direction. There is only slight Gaussian scattering at the exit surface. The luminance distribution is close to uniform at 65 degrees, which is a typical viewing angle at which luminaires are seen in a large office.

Figure 12:
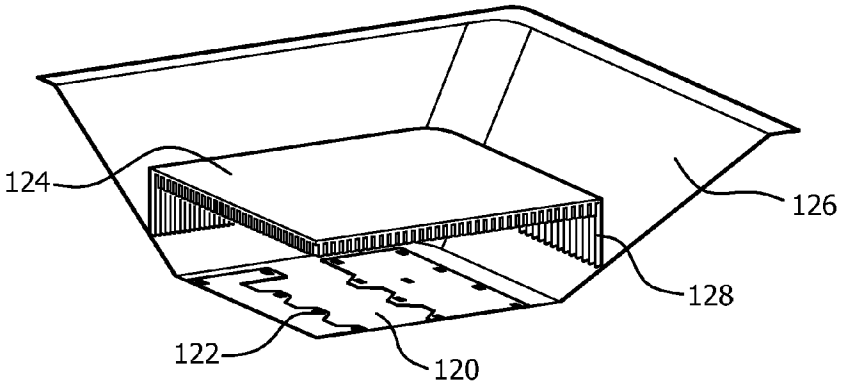
FIG. 12 shows a first example of complete lighting unit of the invention.

FIG. 12 shows a luminaire based on the optical system. The figure shows a quarter cut-out of the total luminaire.

At the bottom side is a PCB 120 with an array of LEDs 122 that emit light with a Lambertian distribution. The optical exit window is the panel 124 with cylinders or truncated cones. For a cost-effective solution, the panel does not cover the complete area of a typical office luminaire (which is usually 60×60 cm or 30×120 cm or 60×120 cm), but a smaller area which is only 25-50% of the total area. The remaining area consists of a baffle 126 that reflects part of the light from the central area and forms a smooth transition from the bright exit window to the ceiling.

The exit window defined by the panel may be a flat plane, but it can instead be raised to enhance the brightness reduction by scattering. For this purpose, the panel may contain perpendicular transparent sidewalls 128 that may be formed together with the panel as a single injection moulded unit.

In order to ensure maximum scattering without changing the beam shape, the protrusions on these sidewalls should have the same orientation as the protrusions on the top side, namely vertically oriented cylinders or otherwise linear structured shapes.

Figure 13:
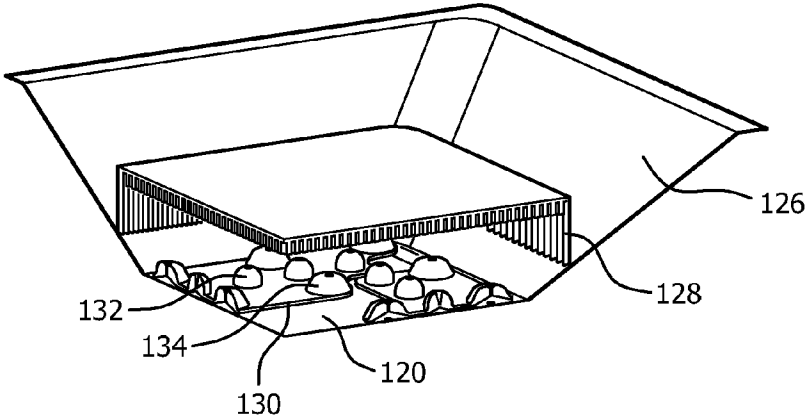
FIG. 13 shows a second example of complete lighting unit of the invention including pre-shaping lenses.

FIG. 13 shows a similar system, but with additional beam forming optics in the form of lens array plates 130 placed on the PCBs.

The lens arrays may be used to collimate the beam even further, either to improve the beam cut-off to improve glare reduction or to make a more narrow beam for other applications than general lighting.

Alternatively, the lens arrays may be of the batwing type, to broaden the beam.

In one specific example shown in FIG. 13, the lens arrays 130 produce two distinct beams: a narrow beam for task lighting and a wide beam for ambient lighting. As shown in FIG. 13, there are two different designs of microlens 132 and 134 for this purpose.

A challenge in the optical design of such a system is the balance between brightness reduction (strong scattering needed) and beam conservation (weak scattering needed).

This is achieved by decoupling the two properties. In this way, strong scattering can be obtained without broadening the beam. Furthermore, the total luminaire height can be made lower.

Figure 14:
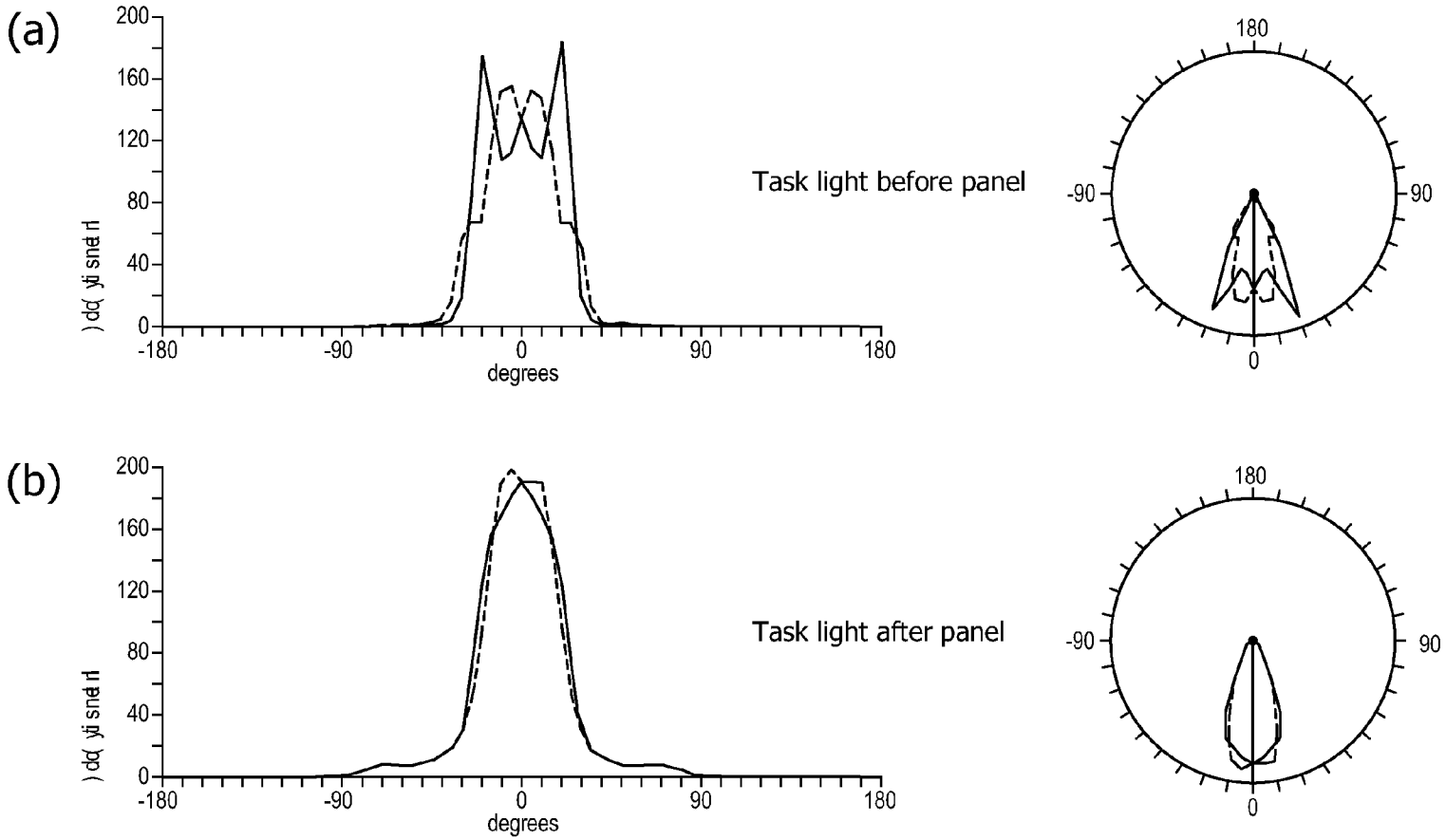
FIG. 14*a-d* shows the light intensity distribution and polar plot for a system which generates task light and ambient light by use of pre-shaping lenses, before (FIGS. 14(*a*) and 14(*c*)) and after (FIGS. 14(*b*) and 14(*d*)) passage through the optical panel.
Figure 14:
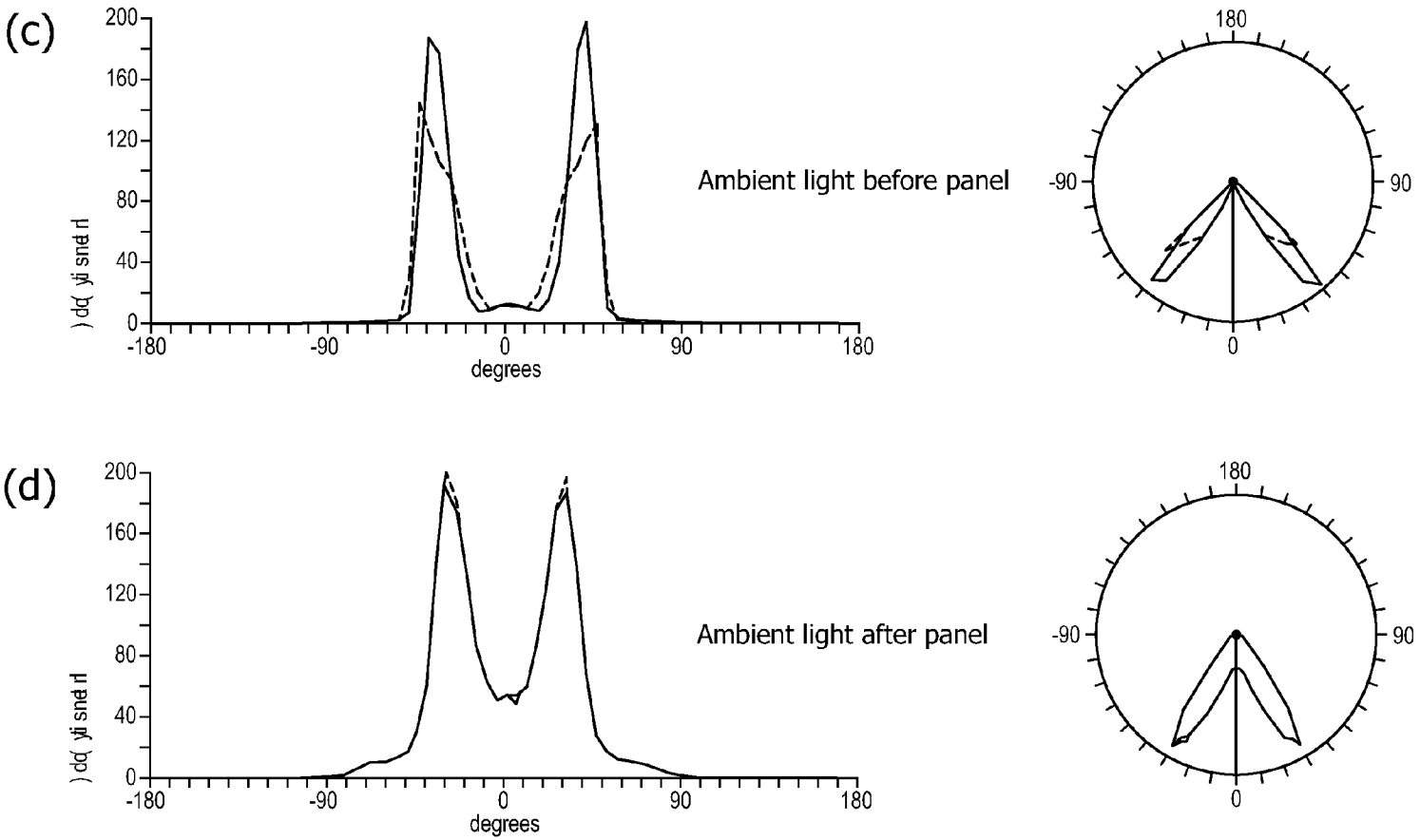

The effect of the truncated cones on pre-shaped beams is shown in the intensity plots of FIG. 14.

Each graph of FIGS. 14(*a*) to 14(*d*) includes two curves, one for a cross section at a polar angle of 0 degrees, and one a cross section at a polar 90 degrees. The left hand plots are intensity distributions in Cartesian coordinates, the same intensity distributions are shown in the right hand plots in polar coordinates.

FIGS. 14(*a*) and 14(*c*) shows two complementary beams (a relatively narrow beam in FIG. 14(*a*) representing task light and a wider "hollow" beam in FIG. 14(*c*) representing ambient light). These together form a typical office lighting beam.

The use of two complementary beam patterns to form a split beam luminaire is for example described in WO2011/0369690 and WO2013/057644.

FIGS. 14(*b*) and 14(*d*) show the same beams after passing the optical plate according to one example of the invention. The beam shape is largely conserved with respect to polar angle distribution (little scattering in polar angle direction), but the beam is also made more rotationally symmetric around the optical axis (good scattering in tangential direction).

If the two plots for the two different angles are very different (as in FIGS. 14(*a*) and 14(*c*)) it indicates an asymmetric light distribution. The system of the invention can provide sufficient angular scattering to smooth out this original undesired property These images thus show two significant effects.

(i) The beam rotational symmetry is improved by the angular scattering. The initial asymmetry of the input beams is an unwanted side effect of asymmetric low cost LEDs.

(ii) A background of diffuse light is created by light that passed through the intermediate area with slanted facets instead of through the cone tops. A limited amount of light also is distributed under high angles, up to 90 degrees. This can be seen based on the wider base curve.

The first effect is an advantage. The second effects is not desired. This effect may be reduced by reducing the slant angle. A slant angle as low as 1 degree or 0.5 degree can be used instead of the example of 3.4 degrees used in the simulations shown above.

The invention is of particular interest for indoor professional lighting, especially office applications. Typically, an array of luminaires is provided over a space to be illuminated. Although the invention is described with reference to LED lighting, the panel can be applied to a luminaire with other types of light source. The panel dimension of 40 cm×40 cm is of course only an example, which is representative for use as an overhead office luminaire. Other dimensions will be appropriate for other uses, such as decorative lighting.

Designs according to embodiments of the invention can result in efficiency of around 90% compared to about 70% for existing microlens systems.

In the examples above, the light modifying panel is a flat plate with the protrusions. However, the overall plate may instead be curved. For example, the light source may be a point source without collimation and the substrate can then be a semi-sphere with a large radius, with the protrusions facing the source. In this case, the smooth semi-spherical surface is perpendicular to the light rays, which reduces unwanted Fresnel reflections. Thus, the term panel should not be understood as requiring a flat planar panel, although this is indeed one preferred implementation.

Figure 15:
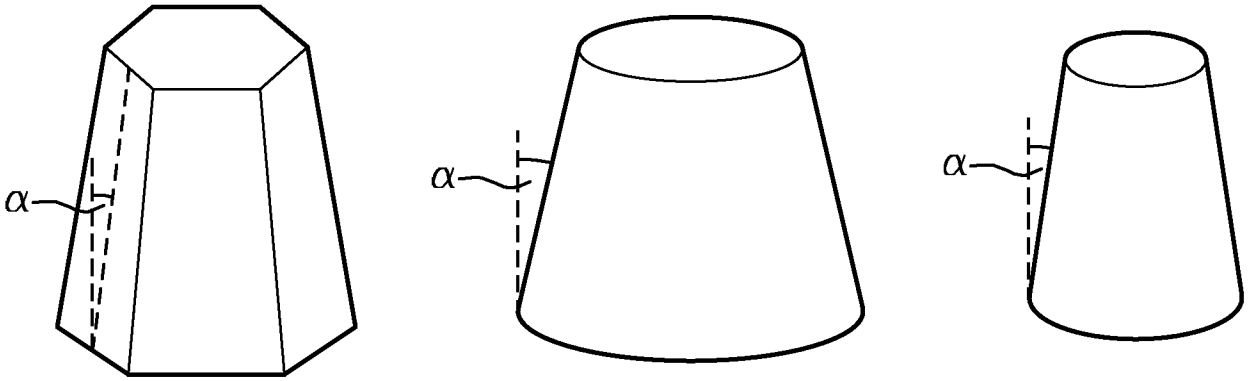
FIG. 15 shows schematically a polygonal (hexagonal), elliptical and circular shape for the protrusions.

As mentioned above, the protrusions can be circular, elliptical or polygonal, with 5 or more sides. FIG. 15 shows schematically a polygonal (hexagonal), elliptical and circular shape for the protrusions. For a polygonal shape, the shape approximates a circle as the number of sides is increased.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting unit, comprising:

a light source comprising an array of LEDs with a first pitch; and a light modifying panel positioned over the light source for modifying the light output from the light source before it enters a space to be illuminated, wherein the panel comprises a base and a set of protrusions over the base, the protrusions facing the light source, the set of protrusions having a second pitch different from the first pitch, wherein the protrusions comprise circular, elliptical or at least 5-sided polygonal cylinders, or circular, elliptical or at least 5-sided polygonal cone sections, having a flat circular elliptical or polygonal top, wherein for cone sections the cone taper angle is less than 5 degrees.

2. A unit as claimed in claim 1, wherein for cone sections, the cone taper angle is less than 2 degrees.

3. A unit as claimed in claim 1, wherein for cone sections, the cone taper angle is less than 1 degree.

4. A unit as claimed in claim 1, wherein the base comprises a light scattering surface on a side opposite the protrusions.

5. A unit as claimed in claim 1, wherein the tips of the protrusions are provided with a scattering surface.

6. A unit as claimed in claim 1, further comprising a diffuser between the light source and the panel.

7. A unit as claimed in claim 1, wherein the panel is injection moulded.

8. A unit as claimed in claim 1 comprising a ceiling luminaire.

9. A lighting unit, comprising:

a light source comprising an array of LEDs with a first pitch; and a light modifying panel positioned over the light source for modifying the light output from the light source before it enters a space to be illuminated, wherein the panel comprises a base and a set of protrusions over the base, the protrusions facing the light source, the set of protrusions having a second pitch different from the first pitch, wherein the protrusions comprise circular, elliptical or at least 5-sided polygonal cylinders, or circular, elliptical or at least 5-sided polygonal cone sections, having a flat circular elliptical or polygonal top, wherein for cone sections the cone taper angle is less than 5 degrees, wherein the protrusions each have a height H which satisfies $H>N\ (D-H*\tan\alpha)$, where $\alpha$ is the cone taper angle with $\alpha=0$ for cylinders, D is the diameter of the tip, and N is given by $1/N=\tan(\sin^{-1}(\sin 35/n))$ where n is the refractive index of the panel material.

10. A unit as claimed in claim 9, wherein N is in the range 2.3 to 2.7.

11. A unit as claimed in claim 10, further comprising a beam shaping optical arrangement provided over the LED array.

12. A unit as claimed in claim 11, wherein the beam shaping optical arrangement performs a collimation function.

13. A unit as claimed in claim 11, wherein the beam shaping optical arrangement performs a batwing optical distribution function.

14. A unit as claimed in claim 11, wherein the beam shaping optical arrangement comprises at least first and second different types of lens.

* * * * *